US006331122B1

(12) United States Patent
Wu

(10) Patent No.: US 6,331,122 B1
(45) Date of Patent: Dec. 18, 2001

(54) ELECTRICAL CONNECTOR HAVING A REDUCED LONGITUDINAL DIMENSION

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/907,098

(22) Filed: Jul. 16, 2001

(51) Int. Cl.[7] ..... H01R 13/60
(52) U.S. Cl. ..... 439/567; 439/378; 439/374
(58) Field of Search ..... 439/567, 571, 439/374, 378, 637, 680

(56) References Cited

U.S. PATENT DOCUMENTS 4,993,965 * 2/1991 Eck ..... 439/374
5,466,171 * 11/1995 Bixler et al. ..... 439/378
6,093,046 * 7/2000 Chiou et al. ..... 439/378

* cited by examiner

*Primary Examiner*—Tho D. Ta
(74) *Attorney, Agent, or Firm*—Wei Te Chung

(57) ABSTRACT

An electrical connector (10) includes an insulative housing (12), a number of contacts (14) received in the housing and a pair of board locks (16) attached to opposite side faces (18) of the housing. The housing provides a pair of guiding blocks (28) and a pair of retention portions (36) outwardly extending from the side faces of the housing. The guiding blocks are located above the retention portions and a space is defined between each guiding block and a corresponding retention portion for facilitating assembly of the board lock to the retention portion. Each retention portion does not extend beyond a plane defined by an outermost surface of the guiding block in a longitudinal direction of the housing and the board lock is located between the outermost surface of the guiding block and the side face of the housing, thereby minimizing the longitudinal dimension of the connector.

15 Claims, 4 Drawing Sheets

ELECTRICAL CONNECTOR HAVING A REDUCED LONGITUDINAL DIMENSION

BACKGROUND OF THE INVENTION

1. Field of the Invention

The present invention relates to an electrical connector, and particularly to an electrical connector having a reduced longitudinal dimension.

2. Description of the Related Art

Computers are widely used in the fields of E-commerce, E-business, Home network, internet work station and so on. Each computer has a data storage center, e.g. hard disk, where computer software and business data information are saved. When the computer runs, the computer Central Processing Unit (CPU) continuously accesses the hard disk and takes data from the hard disk or saves data to the hard disk. The CPU is commonly connected to the hard disk via flat flexible cables (FFCs) and FFC connectors assembled to opposite ends of the FPCs. For compatibility, the hard disk driver interfaces are standardized. There are many hard disk driver interface standards and the SCSI families and ATA families are the most famous in the last decade. The electrical connector used in hard disk driver must comply with the corresponding interface standards. Last year, an organization, called the Serial Advanced Technology Attachment (SATA) Working Group and set up by APT Technologies Inc, Dell Computer Corporation, International Business Machines, Intel Corporation, Maxtor Corporation, Quantum Corporation, and Seagate Technology released a specification to define the SATA interface and the corresponding connectors. The specification defines a first type of SATA connector connecting to a cable and a second type of SATA connector mounting to a printed circuit board (PCB).

The second type of SATA connector defined by the specification includes an insulative housing, a plurality of contacts received in the housing and two board locks fixed to the housing for attaching the connector to the PCB. The housing provides a guiding post on each one of two opposite side faces of the housing for guiding the connector to mate with a mating connector. The housing also provides a retention portion on each of the opposite side faces connected to a corresponding guiding post. Since the guiding post is connected to the corresponding retention portion, the retention portion must further outwardly extend a certain distance beyond an outermost surface of the guiding post to provide a base for retaining the corresponding board lock. Thus, the connector has a relatively larger dimension. This design does not answer for the small dimension requirement in computer industry. Hence, an improved electrical connector is required to overcome the disadvantages of the prior art.

SUMMARY OF THE INVENTION

An object of the present invention is to provide an electrical connector having a reduced longitudinal dimension.

To obtain the above object, an electrical connector includes an insulative housing, a number of contacts received in the housing and a pair of board locks attached to opposite side faces of the housing. The housing provides a pair of guiding blocks and a pair of retention portions outwardly extending from the side faces of the housing. The guiding blocks are located above the retention portions and a space is defined between each guiding block and a corresponding retention portion for facilitating assembly of the board lock to the retention portion. Each retention portion does not extend beyond a plane defined by an outermost surface of the guiding block in a longitudinal direction of the housing and the board lock is located between the outermost surface of the guiding block and the corresponding side face of the housing, thereby minimizing the longitudinal dimension of the connector.

As details of the above description, the blocks are integrally formed adjacent a mating surface of the housing and each has a section extending beyond the mating surface to sever as a guiding means. The retention portions are integrally formed adjacent the mounting surface of the housing and each has a section extending beyond the mounting surface to serve as a stand-off. Each retention portion defines a groove for securely receiving the corresponding fastener therein.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
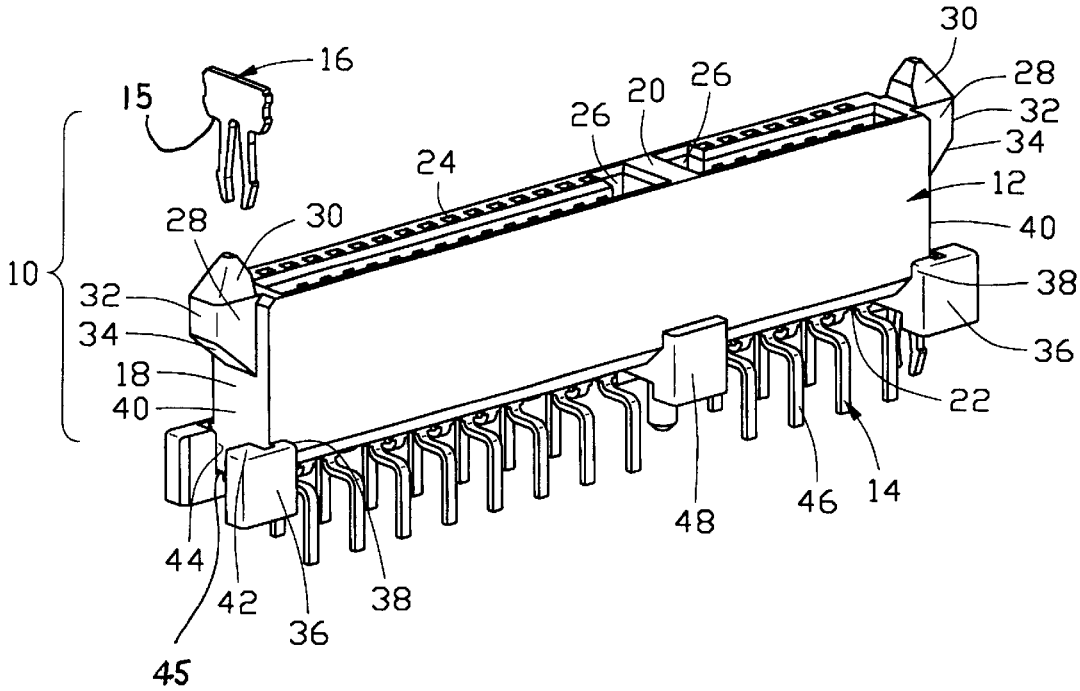
FIG. 1 is a perspective view of an electrical connector of the present invention, wherein a board lock is removed from an insulative housing.

Referring to FIGS. 1–5 and first to FIG. 1, an electrical connector 10 of the present invention comprises an insulative housing 12, a plurality of contacts 14 received in the housing 12 and a pair of fasteners 16, for example board locks, attached to opposite side faces 18 of the housing 12. The connector 10 has a portion for mating with a mating connector (not shown) and a portion for mounting onto a printed circuit board (PCB, not shown).

The housing 12 has a mating surface 20 and a mounting surface 22 and defines a plurality of contact receiving cavities 24 and two slots 26 between the mating surface 20 and the mounting surface 22. The housing 12 provides a pair of guiding blocks(posts) 28 outwardly protruding from respective side faces 18 of the housing 12 in a longitudinal direction of the housing 12. The guiding blocks 28 are located adjacent to the mating surface 20 and each has a sharp section 30 upwardly extending beyond the mating surface 20 for guidance of the connector 10 to mate with the mating connector. Each guiding block 28 has an outermost surface 32 which distances from the corresponding side face 18 the largest distance in the longitudinal direction of the housing 12. Each guiding block 28 has an inclined bottom surface 34. The housing 12 further provides a pair of retention portions 36 at respective corners 38 of the housing 12 adjacent the mounting surface 22. The retention portions 36 are located under the respective guiding blocks 28 and a space 40 is defined between the bottom surface 34 of each guiding post 28 and an upper surface 42 of the respective retention portion 36. Each retention portion 36 outwardly extends beyond the respective side face 18 in the longitudinal direction of the housing 12 and downwardly extends beyond the mounting surface 22 of the housing to provide stand-off function. To minimize the longitudinal dimension of the housing 12, each retention portion 36 preferably does not extend beyond a vertical plane defined by the outermost surface 32 thereof in the longitudinal direction. Each retention portion 36 defines a groove 44 in the upper surface 42 thereof where the respective fastener 16 is received. In a preferred embodiment of the invention, each retention portion includes two pieces between which the respective fastener is sandwiched (best shown in FIGS. 3 and 5). Each contact 14 has a mounting portion 46 extending beyond the mounting surface 22 of the housing 12. The mounting portion 46 parallelly and outwardly extends a certain distance and then downwardly extends for mounting to the PCB. The housing 12 further includes a supporting means 48 generally located at a middle section thereof for supporting the connector 10 while it mates with the mating connector.

Figure 3:
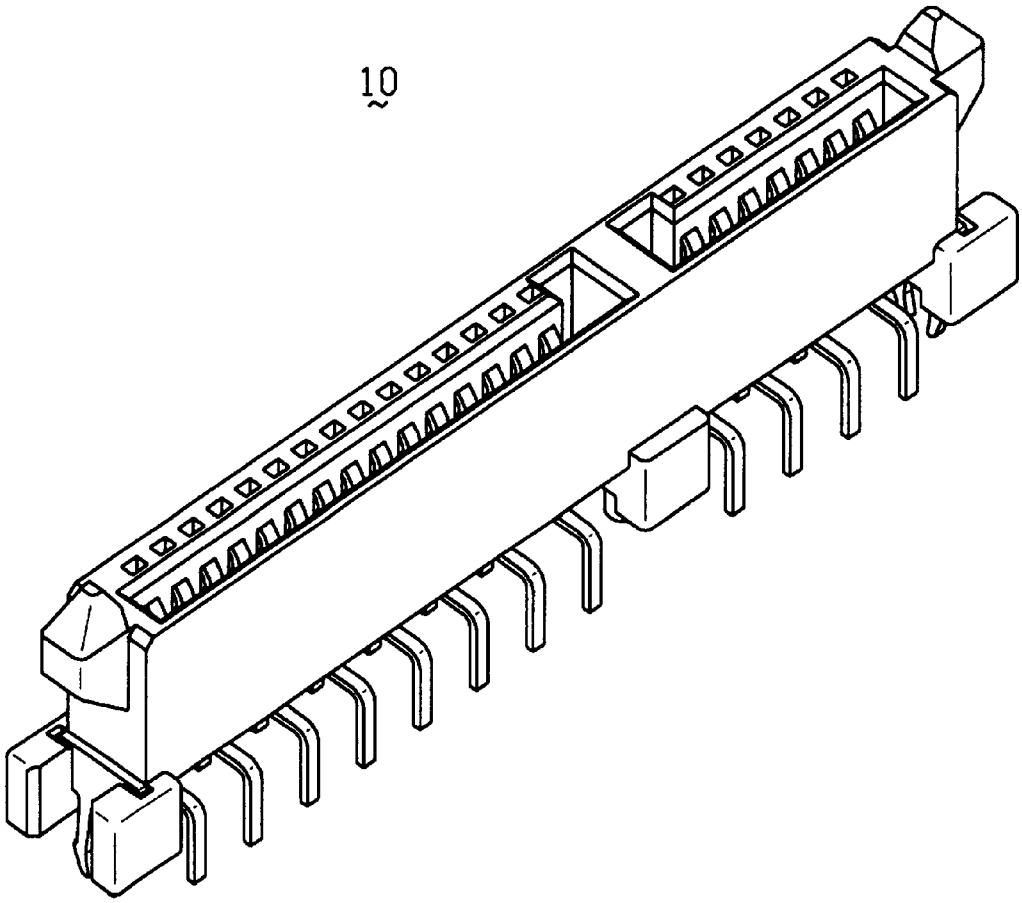
FIG. 3 is a view similar to FIG. 1 but the board lock is assembled to the housing.
Figure 4:
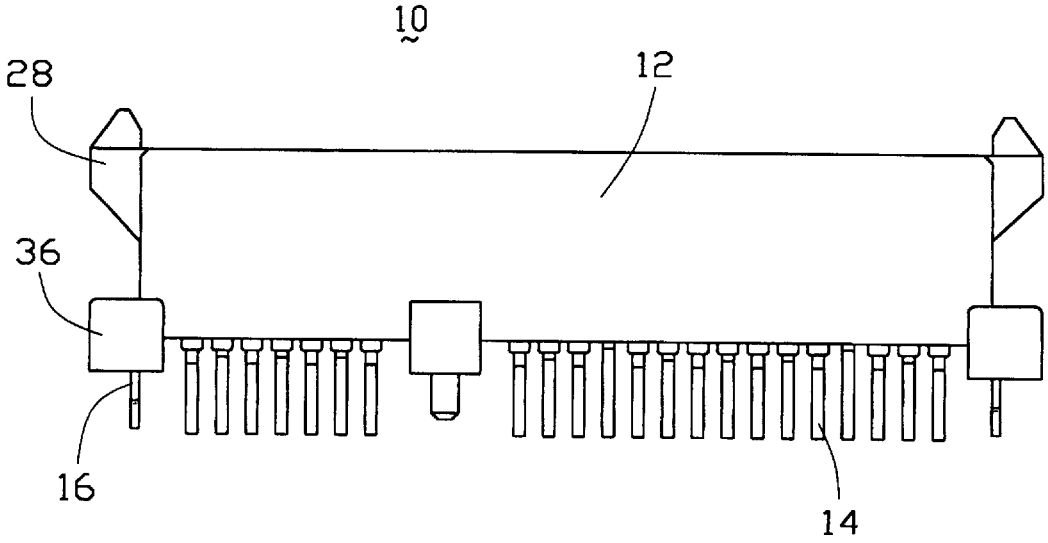
FIG. 4 is a front planar view of FIG. 3.
Figure 5:
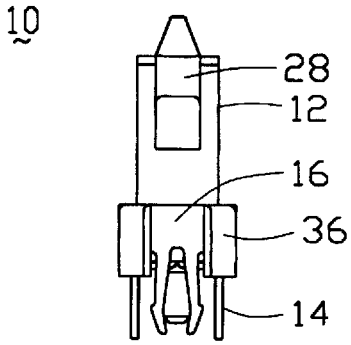
FIG. 5 is a side planar view of FIG. 4.

As best shown in FIGS. 3 and 4, the fastener 16 is located between the side face 18 of the housing and the plane defined by the outermost surface 32 of the guiding post 28. In other word, the fastener 16 does not extend beyond the plane defined by the outermost surface 32 in the longitudinal direction of the housing 12. Furthermore, the retention portion 36 also does not extend beyond the plane defined by the outermost surface 32 in the longitudinal direction of the housing 12. Thus, the largest dimension of the housing 12 in the longitudinal direction is defined by the outermost surfaces 32, which has been adapted as a standard. So, the connector of the invention has the minimal longitudinal dimension of this type of serial ATA connector.

Figure 2:
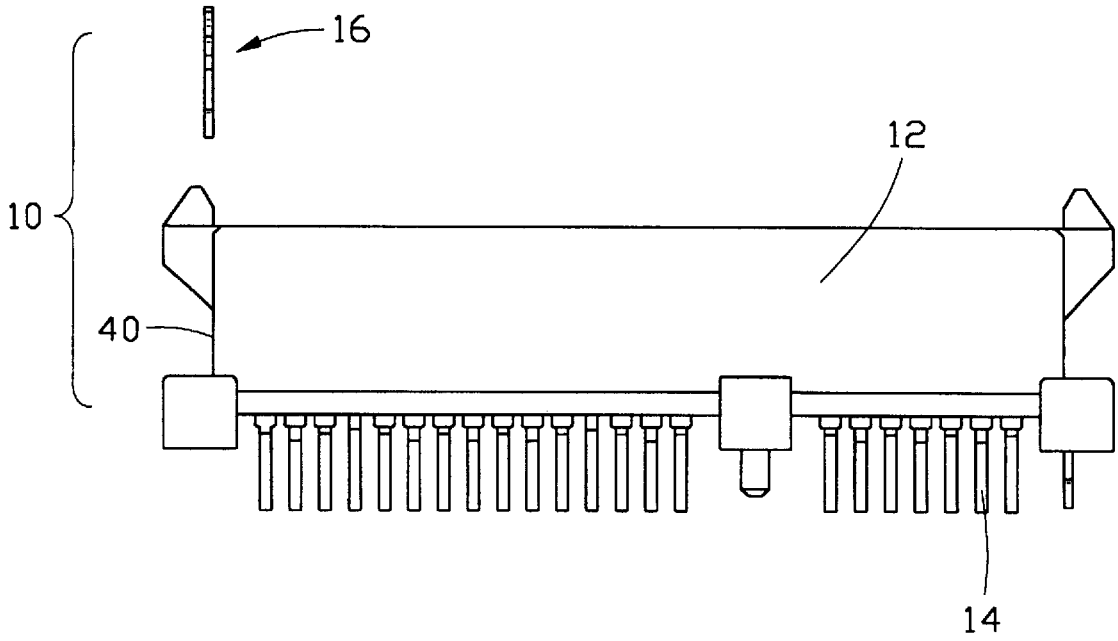
FIG. 2 is a front planar view of FIG. 1.

As best shown in FIG. 2, the fasteners 16 can not be assembled to the retention portions 36 of the housing 12 vertically because of the stop of the guiding block 28. So, the invention defines the space 40 between the bottom surface 34 of the guiding block 28 and the upper surface 42 of the retention portion 36. When assembling the fastener 16 to the groove 44 of the retention portion 36, the space 40 may accommodate a portion of the fastener 16, thereby facilitating the assembly process. During the assembly process, the fastener 16 goes through a curvilinear trail. Understandably, in the embodiment the fastener 16 is of top loading rather than bottom loading or side loading, in which referring to FIG. 1, the shoulder 15 of the fastener 16 can be seated upon the step 45 of the retention portion 36 so that there is no possibility for the housing 12 to leave the fastener 16 and the associated PCB soldered thereto when the housing 12 tends to move away from the PCB thereunder during vibration. In opposite, a bottom loading fastener may take a risk under such vibration to have the housing leave the fastener and the associated PCB soldered thereunder. The invention provides a solution to allow the SATA connector as defined by the corresponding standard to be equipped with a pair of board locks, i.e., fasteners, located within a limited region defined by the housing and/or the guiding posts under a preferred top loading manner. The space 40 provided among the side face 18, the guiding block 28 and the retention portion 36, allows a curved top loading of the fastener 16 with regard to the housing 12 for implementation of the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an elongated insulative housing having a mating surface, a mounting surface and a pair of opposite side faces, the housing including a block protruding outwardly from one of the side faces in a longitudinal direction of the housing;

a plurality of conductive contacts received in the housing; a fastener fixed to the housing and located under the block inwardly of a plane defined by an outermost surface of said block;

wherein the block serves as a guiding post for guiding the connector to a mating connector;

wherein the housing includes a retention portion to which said fastener is fixed, a space being defined between the block and the retention portion; and wherein the retention portion includes two pieces spaced from each other in a transverse direction of the housing between which the fastener is sandwiched.

2. The electrical connector as claimed in claim 1, wherein the block is located adjacent the mating surface of the housing and has a section protruding beyond the mating surface.

3. The electrical connector as claimed in claim 1, wherein the retention portion does not exceed the plane defined by the outermost surface of the block in the longitudinal direction of the housing.

4. The electrical connector as claimed in claim 1, wherein a space is defined between a bottom surface of the block and an upper surface of the retention portion.

5. The electrical connector as claimed in claim 1, wherein the retention portion is integrally formed at an end portion thereof and has a section extending beyond the mounting surface of the housing to serve as a stand-off.

6. The electrical connector as claimed in claim 1, wherein the retention portion defines a groove for securely receiving the fastener therein.

7. The electrical connector as claimed in claim 1, wherein each contact has a mounting portion horizontally and outwardly extending a predetermined distance and then downwardly extending a predetermined distance.

8. The electrical connector as claimed in claim 1, wherein the fastener goes a curvilinear trail when it is assembled to the retention portion.

9. The electrical connector as claimed in claim 1, wherein the fastener is a board lock.

10. An electrical connector comprising:

an insulative housing having a mating surface, a mounting surface, two opposite side faces and defining a plurality of cavities and a slot between the mating surface and the mounting surface, the housing providing a block and a retention portion on one of the side faces thereof, a space being defined between the block and the retention portion;

a plurality of conductive contacts received in the respective cavities of the housing;

a fastener fixed to the retention portion of the housing and located under the block; and wherein the block serves as a guiding post for guiding the connector to a mating connector.

11. The electrical connector as claimed in claim 10, wherein each retention portion does not exceed beyond a plane defined by an outmost surface of the respective block.

12. The electrical connector as claimed in claim 10, wherein the fastener is located between one of the side faces of the housing and an outmost surface of the block.

13. The electrical connector as claimed in claim 10, wherein the retention portions are located under the respective blocks and does not extend shades of the respective blocks in a longitudinal direction of the housing.

14. The electrical connector as claimed in claim 13, wherein each retention portion has a section extending beyond the mounting surface of the housing to provide stand-off function.

15. An electrical connector comprising:

an insulative housing with a plurality of contacts therein;

a pair of engagement blocks positioned at two opposite ends of the housing, respectively;

a pair of retention portions positioned at said two opposite ends of the housing, respectively, each of said retention portions generally aligned with the corresponding one of said engagement blocks in a direction perpendicular to a lengthwise direction of said housing;

a space being formed between said each of said retention portions and the corresponding engagement block; wherein because of said space, a fastener is assembled to the corresponding retention portion through a curved top loading manner; and wherein each block serves as a guiding post for guiding the connector to a mating connector.

* * * * *